US005081567A

United States Patent [19]

Weiss

[11] Patent Number: 5,081,567

[45] Date of Patent: Jan. 14, 1992

[54] ROOF BEAM FLOOD LIGHTING SYSTEM AND METHOD

[76] Inventor: Harvey I. Weiss, 911 Mount Vernon, Lake Forest, Ill. 60045

[21] Appl. No.: 653,259

[22] Filed: Feb. 11, 1991

[51] Int. Cl.[5] ..... E04F 19/00

[52] U.S. Cl. ..... 362/147; 362/145; 52/28

[58] Field of Search ..... 362/145, 147, 222, 362; 52/28

[56] References Cited

U.S. PATENT DOCUMENTS 3,831,020 8/1974 Paulson ..... 362/145

FOREIGN PATENT DOCUMENTS 1203154 8/1970 Belgium ..... 52/28

0656419 6/1986 Switzerland ..... 52/28

*Primary Examiner*—Ira S. Lazarus

*Assistant Examiner*—Y. Quach

[57] ABSTRACT

An improved flood lighting system for a roof wherein the lighting system is associated with roof beams and each segment of the roof is illuminated by means of light rays emanating from the roof beams to create a desired ambience with minimum scalloping. The invention also includes a method for installing the lighting system and beams.

14 Claims, 9 Drawing Sheets

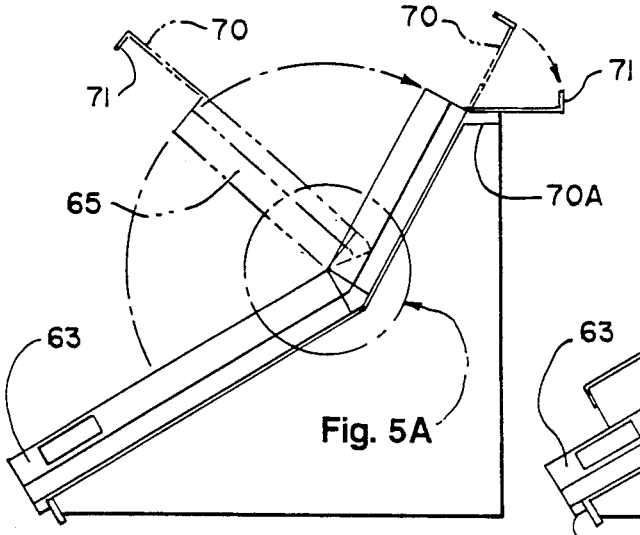
Fig. 5
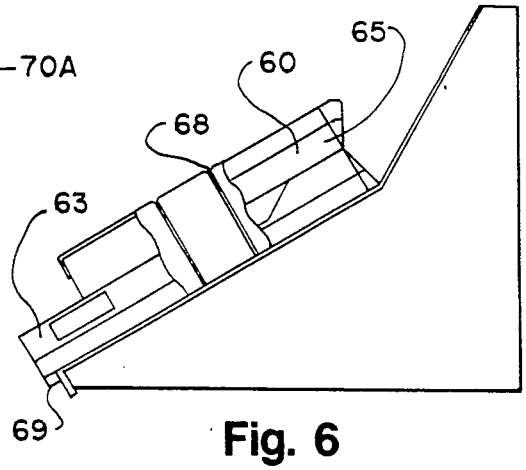
Fig. 6
Fig. 5A
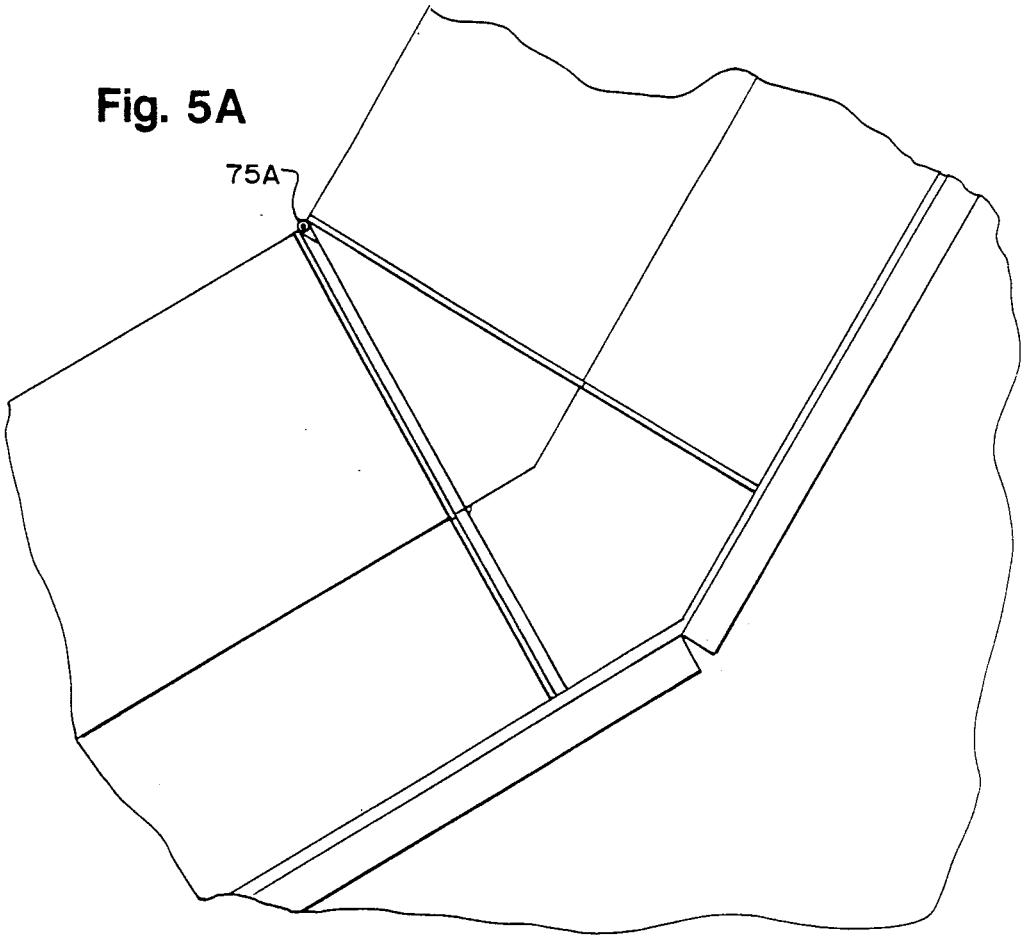

ROOF BEAM FLOOD LIGHTING SYSTEM AND METHOD

BACKGROUND OF THE INVENTION

This invention relates to an improved roof beam flood light system wherein the lighting pattern along a roof segment is unique and the method of assembly of the lighting system and beam is also unique.

Tastefully lighting a roof depends on the requirements of lighting for the particular enterprise that is located within the building under the roof. In restaurant businesses, the lighting of the roof is important insofar as it calls attention to the restaurant. However, the lighting must be tasteful and fitting with the desired ambience of the restaurant. It is therefore an object of this invention to provide a means for lighting a roof where the light rays have a pattern that not only calls attention to the building but also the light ray pattern creates an ambience that is advantageous for a business establishment such as a restaurant.

In dealing with a plurality of restaurants for which roof beam flood lights are desired, one limiting factor is that the lighting system must be easily transported, installed and maintained.

In order to obtain the most advantageous type of lighting on a roof, the invention selectively lights segments between beams on a roof. Thus, while roof beams of this type have been lit before, it has not been done by projecting light rays out the side of the beams to cover the mansard of a roof between the roof beams and thereby create an ambience that is desired from the standpoint of design and appearance. With such a technique, the flood light position on the roof is important. The most optimum illumination occurs when the roof segments being illuminated are completely covered with light and there is minimum scalloping. Accordingly, it is an object of this invention to provide a lighting system where the location of the flood lights project light rays out of the side of roof beams and this creates the most effective illumination of the roof segments.

DESCRIPTION OF THE DRAWINGS

Referring to the drawings wherein like characters of reference indicate corresponding parts throughout:

FIG. 5 is a diagrammatic view illustrating how the hingedly associated beam is assembled with the roof line by means of first anchoring the lower portion of the beam on the facia of the roof and thereafter rotating the lower section, intermediate section and ballast section into their operative positions;

FIG. 5*a* is an enlarged view of the encircled portion of FIG. 5 showing two hinge portions 75 and illustrating how they are mirror imaged and attached together by a hinge pin 75*a* at the valley portion of the roof;

FIG. 6 is a diagrammatic view illustrating how the roof beam, while in its protective wrapping and banding, is shipped and then placed on the roof and has its lower section attached to the facia bracket on the roof so that it can then be unwrapped and moved to the positions as shown in FIG. 5;

DESCRIPTION OF THE PREFERRED EMBODIMENT

Figure 1:
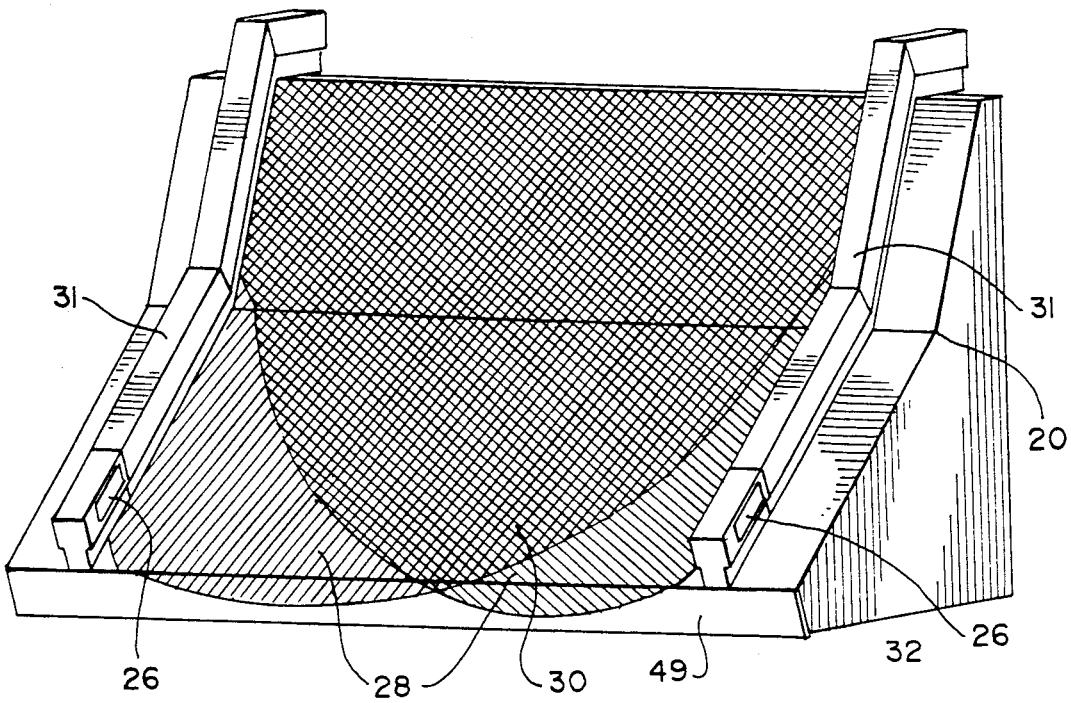
FIG. 1 is a pictorial view of a lighting system illustrating the improved lighting distribution over a segment of the roof.

The overall view of the flood lighting system and how the light rays are distributed is best shown and explained in FIG. 1 wherein a roof segment 20 is shown and has a light distribution pattern represented by lines based on the rays of illumination provided by a pair of lamps 24 which, when illuminated, have the light reflected therefrom by reflectors (now shown) through the lenses 26 at the side of the roof beams 31 and 60. The lines 28 represent that portion of the light beams where the lighting distribution has not been intensified by light rays directed toward each other from an adjacent beam of the roof segment. On the other hand, the cross-hatch lines 30 show the lighting distribution that has been intensified by having two selectively disposed light beams illuminating the roof segment by directed light rays toward an adjacent roof beam through the lenses 26 at the side of the beams.

As can be seen from the roof segment 20, there are a pair of beams 31 that run along the contour of the roof, as generally illustrated in FIG. 1.

Figure 2:
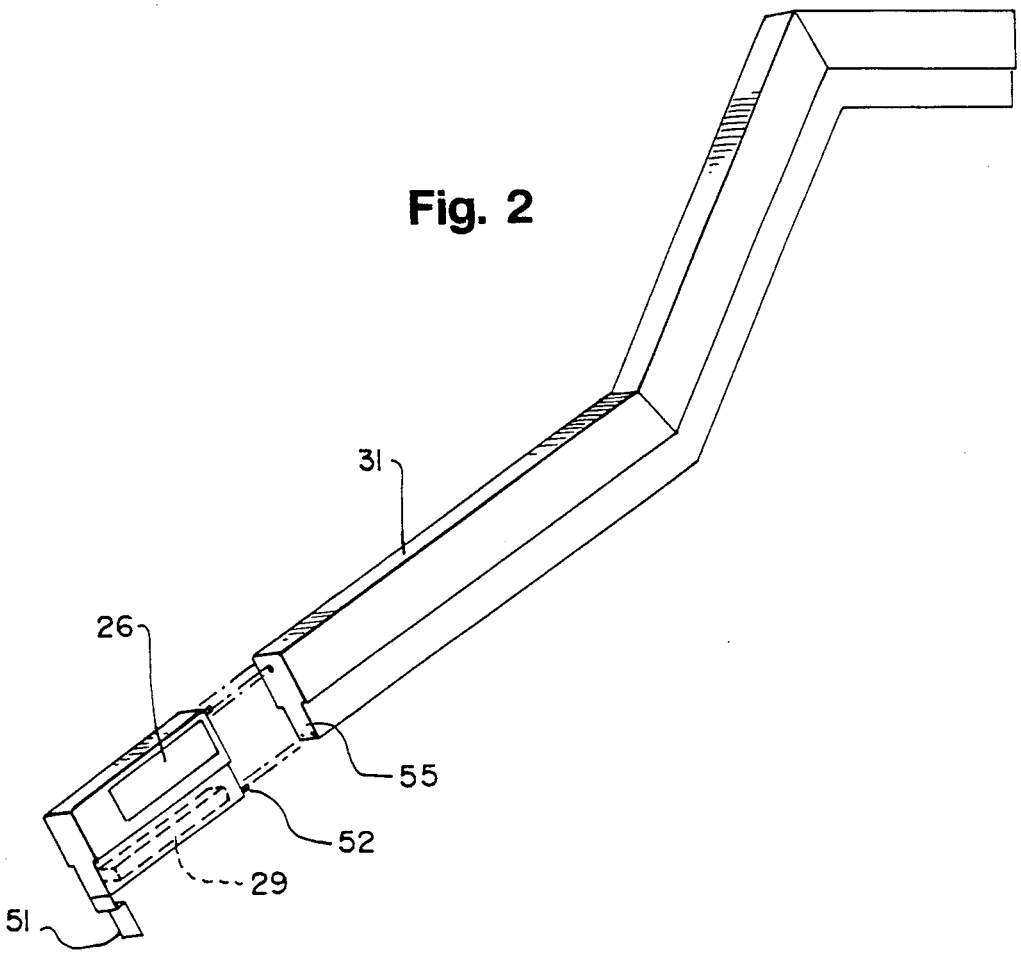
FIG. 2 illustrates a recycled roof beam that has the ballast and lamp portion shown as being part of a retrofitted portion.
Figure 2A:
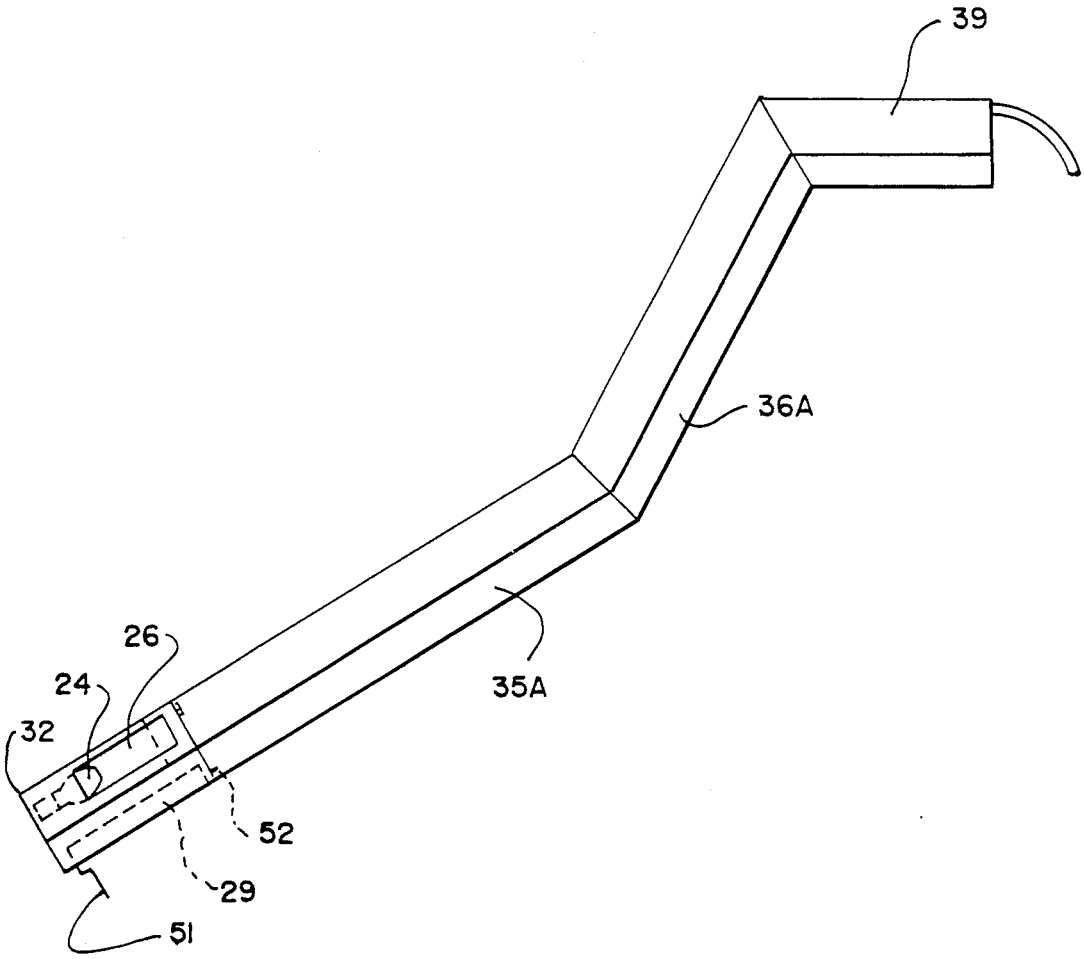
FIG. 2*a* is an assembly drawing of FIG. 2.
Figure 4:
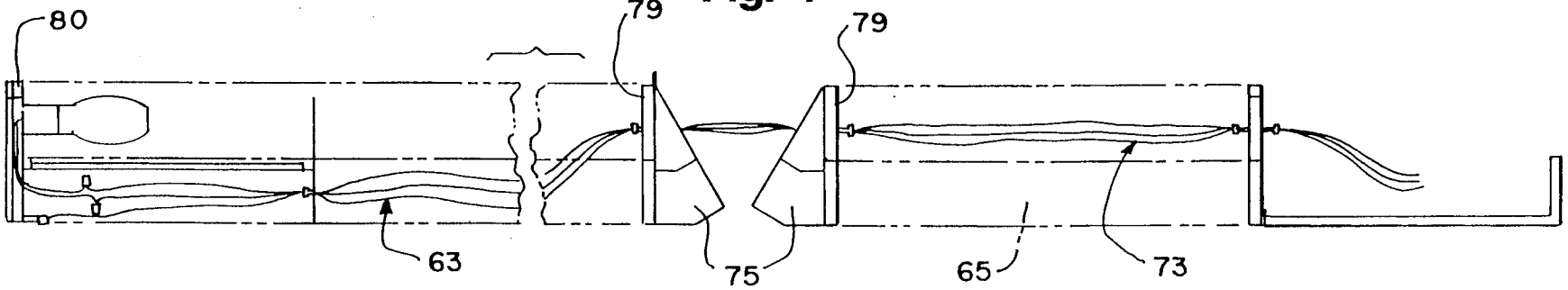
FIG. 4 is a diagrammatic view showing how the wiring assembly in the hingedly associated beam is connected with the lamp as well as the ballast assembly.
Figure 9:
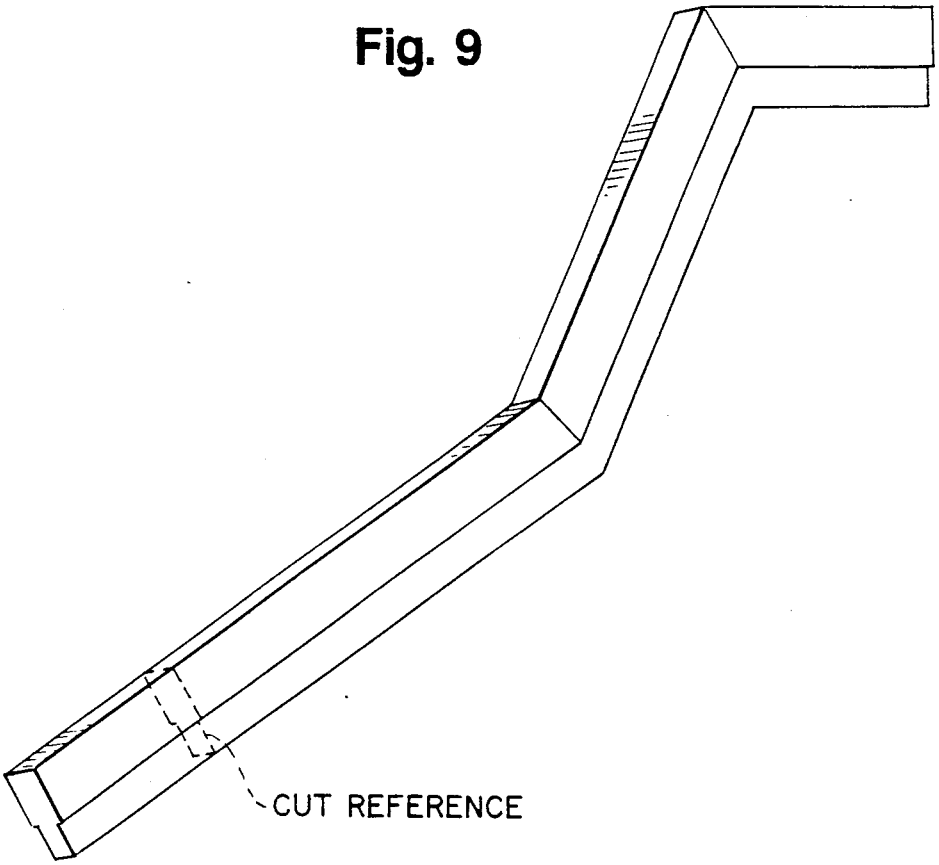
FIG. 9 is a pictorial view of an existing roof beam illustrating the location the beam is to be cut and thereafter attached to a retrofitted portion.
Figure 7:
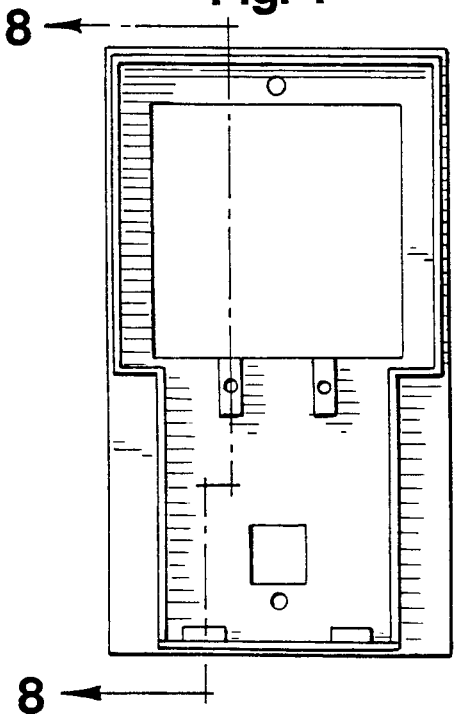
FIG. 7 is a front view of an end frame attached to the lower section of the roof beam.
Figure 8:
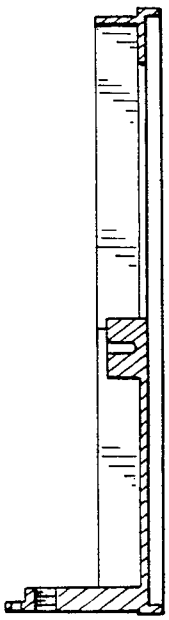
FIG. 8 is a sectional view taken along a plane passing through the line 8—8 and looking in the direction of the arrows.

Referring to FIG. 2, the beams 31 are shown as having three portions: a retrofitted portion 32, which includes the lamp and the ballast 29, an intermediate beam portion 35*a* and 36*a* and a parapet portion 39. With the exception of the retrofitted portion 32, the beams 31 without the improved lighting system have existed prior to this invention. To provide lamps for segment lighting in accordance with this invention in them, a portion thereof is removed and a retrofit portion 32 is fastened thereto. The retrofit portion 32, as seen from FIGS. 2 and 4, includes a lens 26 on each side thereof with a ballast portion 29, located on the bottom thereof and electrically connected to the lamp 24 to provide energy for the lamp. The ballast portion can optionally be located in the parapet portion. However, for this application, the present location is preferred. The flood lamp 24 is preferably a 250 watt metal halide bulb and is positioned at the lenses 26 to obtain the most efficient distribution of light. As seen from FIG. 1, the light rays are directed from the side of a roof beam toward an adjacent beam and over the roof mansard.

Figure 10:
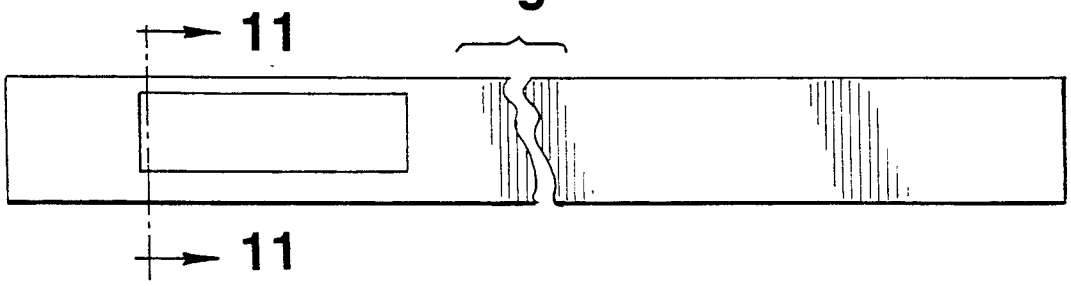
FIG. 10 is a broken off, side elevational view of a lower section of the beam.
Figure 11:
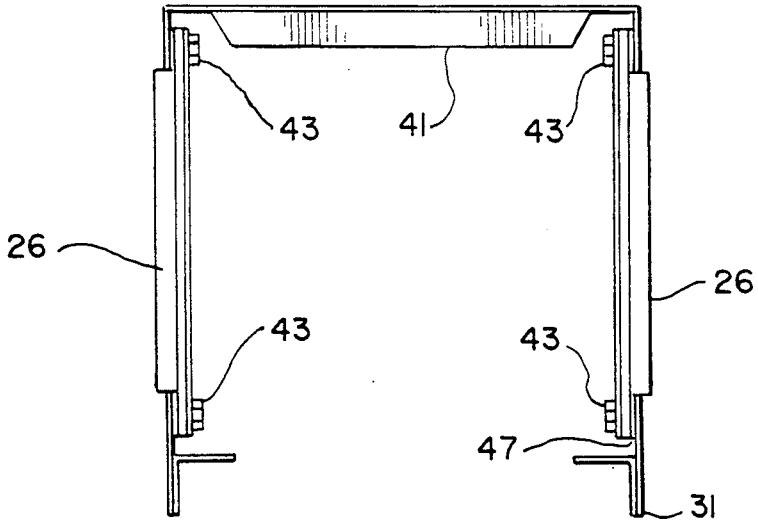
FIG. 11 is a sectional view taken along the line 11—11 and looking in the direction of the arrows.
Figure 12:
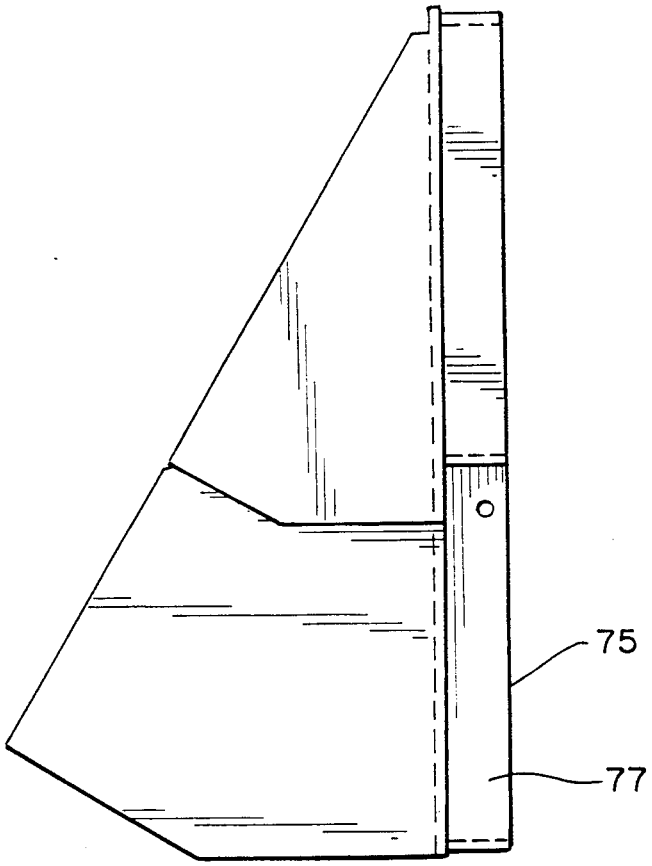
FIG. 12 is a side elevational view of a hinge portion attached at the valley of the roof between the ends of the beam's lower and intermediate sections.
Figure 13:
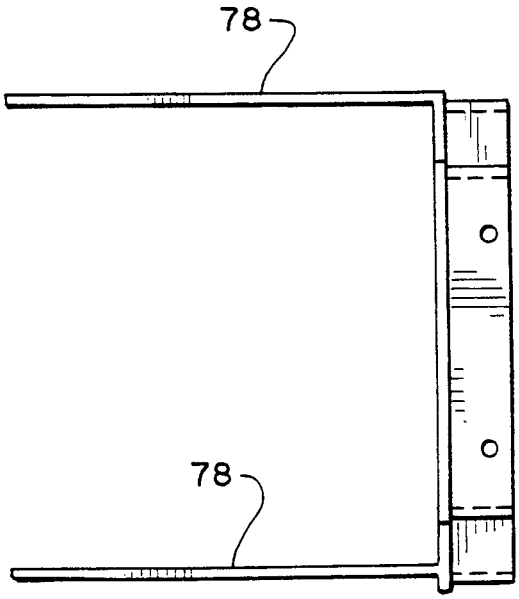
FIG. 13 is a bottom view of FIG. 12.
Figure 14:
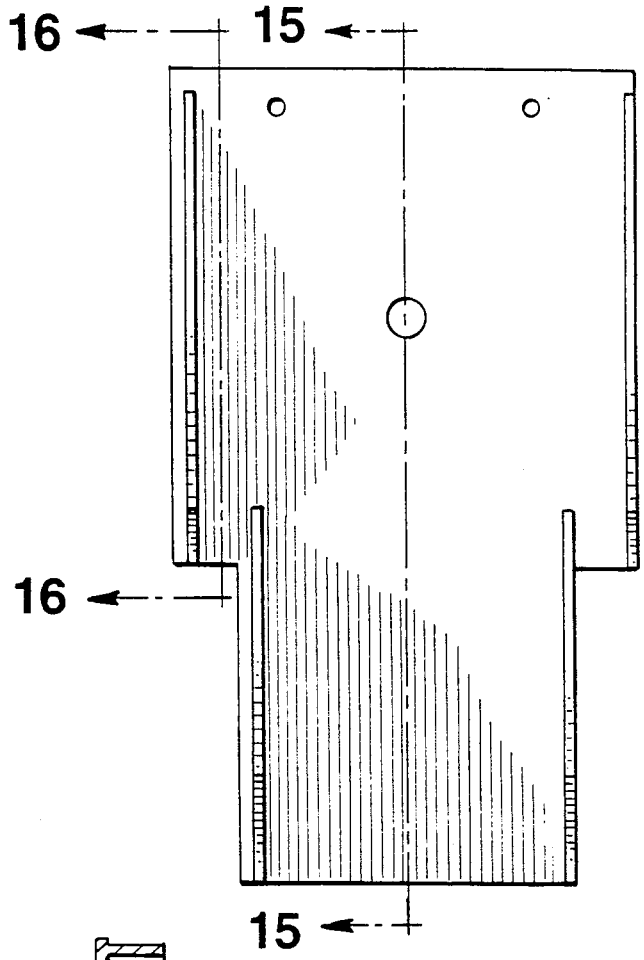
FIG. 14 is a front view of FIG. 12.
Figure 15:
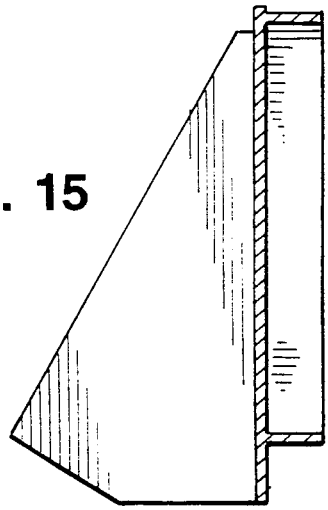
FIG. 15 is a sectional view taken along the line 15—15 in FIG. 14 and looking in the direction of the arrows.
Figure 16:
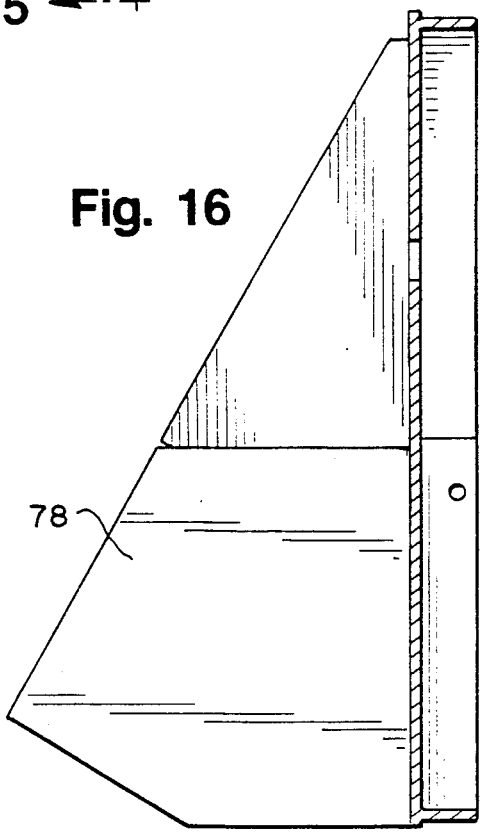
FIG. 16 is a sectional view of FIG. 14 taken along line 16—16 in FIG. 14 and looking in the direction of the arrows.
Figure 17:
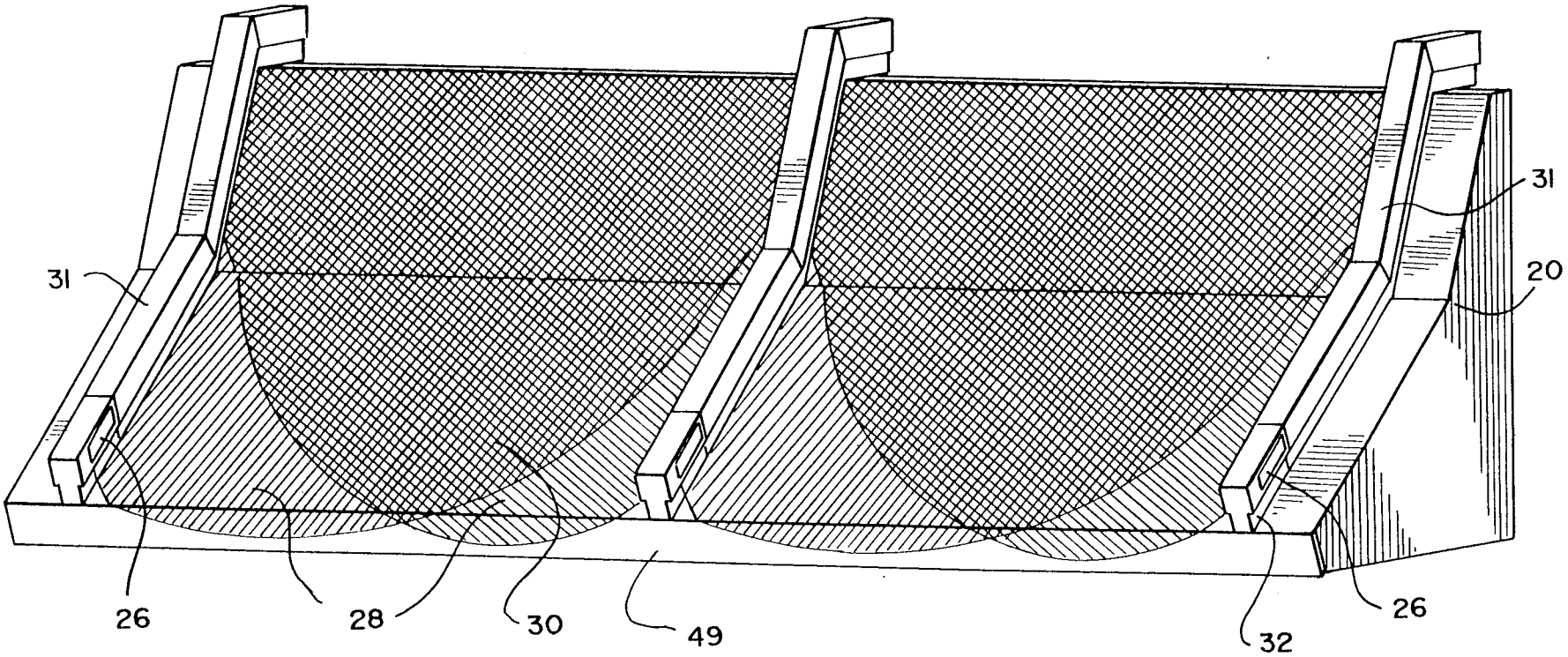
FIG. 17 shows a plurality of roof beams illuminating a roof with several roof segments in accordance with the invention.

As seen from FIGS. 10 and 11, the lenses 26 are associated with the beams 31 at each side thereof by means of the fasteners 43 and have a gasket 47 interposed between the lenses 26 and the inside of the beam 31.

An adjustable roof bracket 51 is shown on the retrofit portion 32 so that the retrofit portion can be mounted to the facia 49 of the roof segment 20 by means of a fastener (not shown). In order to have the flood lamps 24 energized, the ballast 29 is connected to the lamp 24 and its socket (not shown) in the conventional manner and by flexible conduit wires (not shown). These are strung through the roof beam and through the parapet portion 39 to make the electrical connection on the inside of the house covered by the roof segment. The conduit wires are sealed from the outside elements and the retrofit portion 32 is fastened to the existing beam 31 by means of the captive studs 52 extending from the retrofit portion 32 and being received by the end plate 55 which is fastened onto the roof beam 31 after removing a portion in length thereof that corresponds to the length of the retrofit portion 32. The retrofit portion 32 is then held together with the rest of the beam 31.

While any means of permanently fastening the retrofit portion 32 to the remainder of the beam can be applied, the captive studs 52 are received by the beam 31 and fastened by hex nuts (not shown) whereby when it is necessary to remove the ballast and lamp portion from the roof for service, this can be done easily by loosening the fasteners. Thus, the retrofit portion 32 can be removed from the rest of the roof segment, and it can be very easily disassembled from the beam by means of loosening the roof bracket 51 as well as undoing the screws and nuts that hold the retrofit portion together with the beam. A plurality of beams on a roof and the lighting system shown in FIG. 1 in accordance with this invention are illustrated in FIG. 1.

Figure 3:
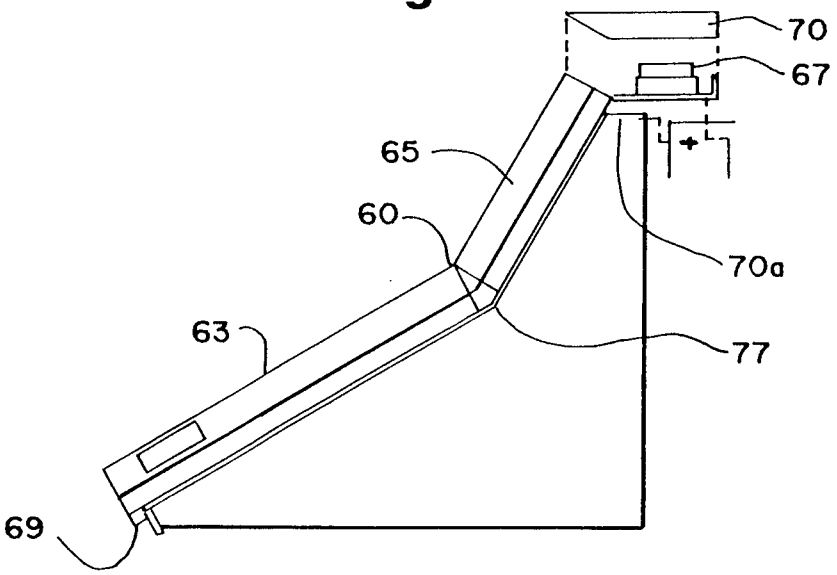
FIG. 3 is a side elevational view illustrating a hingedly associated beam showing how it is associated with the roof.

As seen from FIGS. 3, 5 and 6, a beam 60 has been provided that is essentially constructed and similarly configured to the beam 31 but includes a lower section 63, hingedly associated with an intermediate section 65 and a hingedly fastened parapet section 70. By being hingedly fastened as described, it can be seen from FIGS. 3, 5 and 6 that the beam 60 can be wrapped in a protective wrapping and banding 68 and shipped on site in packages as shown in FIG. 6: with the lower section 63 thereof laid on the roof and associated with the facia by means of a facia bracket 69 being fastened to the lower end. Thereafter the intermediate and parapet sections 65, 70, respectively, can be rotated as shown by the dotted lines in FIG. 5 so that eventually the parapet section 70 can be associated with the roof parapet 70*a* of a roof segment. As illustrated in FIG. 3, the parapet section 70 has a ballast unit 67 mounted therein which can be of any conventional design for purposes of giving power to the lamp 54 by means of a wire assembly of conduit wires 73, shown in FIG. 4. This wire assembly is similar to the type that was described in connection with the beam 31 with the retrofitted portion 32.

As seen from FIGS. 3, 5 and 6, the beam 60 is hingedly associated with its lower section 63 on the bottom and the intermediate and parapet sections above it so that it can be easily installed on a roof by removing the wrapping of the bundle as will be described.

When the beam 60 is shipped, it is wrapped up and bound into a bundle as seen in FIG. 6 with the lower section 63 in the bottom of the bundle and the intermediate section over said lower section. As seen in FIG. 6, the lower section 63 is initially attached to the facia and roof with the facia bracket 69 while still in this bundle. Thereafter, the package is unwrapped and the intermediate section 65 is rotated into place to enable the parapet section 70 to be rotated and respectively put into its installation position as seen in FIG. 5.

This feature of the beam fulfills the objects of installation as well as convenience and handling. The end portion 75 and its mirror image are attached between the sections 63 and 65 at the valley portion 77 of the roof so that the proper angle of the beams is attained to enable the beams to follow the contour of the roof mansard.

The hinge portion 75 is shown in FIGS. 12 through 16, with the flange portions 79 that fit into the beam and are secured by the beam with fasteners (not shown). The sheets 78 extend from the flange portions 79 and allow two hinge portions 75 to be assembled together by the hing pin 75A at the valley portion 77 of the roof when turned and positioned so that they are mirror imaged with respect to one another and the flanged portions are attached in between the ends of the intermediate section and the lower section of the beam 60. The hinge portions 75 are fastened to make up the spacing means that form the angle between the sections 65 and 63 in order that the beam 60 is positioned on the roof line. As seen from FIG. 4, the wire assembly of conduit wires 73 can be connected to the lamp socket 80 and allowed to extend through each of the beam sections and end plates 75 whereby the conduits can be connected to the inside of the building through the parapet 70*a*.

Other objects and advantages will become apparent from viewing the claims.

What is claimed is:

1. An improved flood lighting system for use in illuminating roof segments wherein each segment includes at least a pair of spaced apart roof beams, a roof mansard, and a facia comprising:

a retrofitted portion;

an intermediate portion;

and a parapet portion that extend along the roof mansard to the parapet of a roof, said retrofitted portions of said roof beams being removably associated with said roof beams after a piece of an existing roof beam has been removed from a roof and severed, and said retrofitted portion being disposed and fastened along said mansard between said facia and said intermediate portion of said roof beams, said retrofitted portions having flood lights that are disposed to shine over said roof mansard of said roof segment between said roof beams by having light rays directed over said roof mansard, whereby said flood light system causes an optimum lighting distribution that is intensified where the flood lights' rays from said two adjacent beams overlap along said roof mansard.

2. An improved flood lighting system as defined in claim 1 wherein more than two roof beams of the same construction are installed on said roof, whereby a plurality of roofing segments repeating said optimum lighting distribution is created.

3. An improved flood lighting system as defined in claim 1 wherein said retrofitted portion has an end plate that corresponds in size to the end plate of said intermediate portion that said retrofitted portion is removably associated with.

4. An improved lighting system as defined in claim 1 wherein lenses are located on the sides of said retrofitted portion to allow rays to be directed at said opposing beams as well as cover said roof mansards.

5. An improved flood lighting system as defined in claim 1 wherein said retrofitted portions having fasteners removably associated therewith and fastening said facia, whereby said fasteners can be removed in order for said retrofitted portion to be replaced between the facia and the intermediate portion.

6. An improved flood lighting system for use in illuminating roof segments wherein each roof segment includes at least a pair of spaced apart roof beams, a facia, and a mansard comprising: a lower section, an intermediate section and a parapet section that extend from the facia of the roof to the roof parapet section when installed along the mansard of a roof, one of said sections of said roof beams having a flood light that is disposed to project rays out the sides of each of said roof beams and over said roof mansard between said roof beams by having its rays directed toward an adjacent beam and over said roof, whereby when said flood light system is energized it causes an optimum lighting distribution that is intensified when the flood light rays emanating from said roof beams overlap along said roof mansard.

7. An improved flood lighting system as defined in claim 6 wherein more than two roof beams of the same construction are installed on said roof whereby a plurality of roofing segments repeating said optimum lighting distribution is created.

8. An improved flood lighting system as defined in claim 6, wherein said flood lights are located in said lower sections of said beams.

9. An improved flood lighting system as defined in claim 8 wherein lenses are located on opposing sides of said roof beams to direct light rays toward adjacent beams and over said mansard from said flood lights.

10. An improved flood lighting system as defined in claim 9, wherein at least two sections are hingedly associated with each other in order to provide for ease of shipping and installation.

11. An improved flood lighting system as defined in claim 9, wherein all of said sections are hingedly associated with each other.

12. An improved flood lighting system as defined in claim 10, wherein hinge members are attached to said lower and intermediate sections at a valley portion of said roof to angularly associate said sections along said valley portion of said roof.

13. An improved flood lighting system as defined in claim 12, wherein said hinge members are mirror images of each other and are hinged and attached by hinge pins to said roof at said valley portion of said roof.

14. A process of wrapping, unwrapping and installing a new and improved flood lighting system as defined in claim 11, comprising the steps of:

wrapping the system in a bundle so that the lower, section is on the bottom thereof and the intermediate section is folded over said lower section and the parapet section is over both said intermediate section and said lower section, placing said lower section on said roof and attaching it to said facia;

severing and unwrapping said bundle, thereafter, pivoting said intermediate section so that it is disposed and positioned on said mansard in order that said parapet section can be installed over said roof parapet by pivoting said section in place.

* * * * *